US006222496B1

(12) United States Patent
Liu

(10) Patent No.: US 6,222,496 B1
(45) Date of Patent: Apr. 24, 2001

(54) MODIFIED INVERTED-F ANTENNA

(75) Inventor: Duixian Liu, Yorktown Heights, NY (US)

(73) Assignee: Internaitonal Business Machines Corporation, Armonk, NY (US)

( * ) Notice: Subject to any disclaimer, the term of this patent is extended or adjusted under 35 U.S.C. 154(b) by 0 days.

(21) Appl. No.: 09/434,603

(22) Filed: Nov. 5, 1999

(51) Int. Cl.[7] ..... H01Q 1/48

(52) U.S. Cl. ..... 343/846; 343/700 MS; 343/795

(58) Field of Search ..... 343/700 MS, 702, 343/846, 795, 749; H01Q 1/48

(56) References Cited

U.S. PATENT DOCUMENTS

| | | | | |
|---|---|---|---|---|
| 5,764,190 | * | 6/1998 | Murch et al. | 343/702 |
| 5,912,647 | * | 6/1999 | Tsuru et al. | 343/700 MS |
| 5,926,150 | * | 7/1999 | McLean et al. | 343/846 |
| 6,034,636 | * | 3/2000 | Saitoh | 343/700 MS |
| 6,046,699 | * | 4/2000 | Elliott et al. | 343/702 |

OTHER PUBLICATIONS

Hirasawa et al., "Analysis, Design, and Measurement of Small and Low–Profile Antennas," Artech House, Inc., 1992, Chapter 5, pp. 161–180.

* cited by examiner

*Primary Examiner*—Hoanganh Le
*Assistant Examiner*—Shih-Chao Chen
(74) *Attorney, Agent, or Firm*—Ryan, Mason & Lewis, LLP; Paul J. Otterstedt

(57) ABSTRACT

A modified inverted-F antenna is disclosed that improves on conventional designs by incorporating a sloped grounding element at a fixed end of the horizontal element and a downward bend at a loose end of the horizontal element. The sloped grounding element is connected in a triangular configuration with the feeding element and a ground plane of the antenna, to provide additional benefits. The triangular shape of the present invention decreases the distance, D, between the grounding plane and the feeding element relative to a conventional rectangular connection. The triangular shape also provides increased mechanical strength relative to a conventional rectangular connection. The downward bend at the loose end of the antenna can be adjusted to thereby further adjust the impedance matching of the antenna. The sloped grounding element and downward bend features of the modified inverted-F antenna also serve to reduce the overall dimension of the antenna.

15 Claims, 2 Drawing Sheets

MODIFIED INVERTED-F ANTENNA

FIELD OF THE INVENTION

The present invention relates generally to radio frequency antennas and, more particularly, to inverted-F antennas.

BACKGROUND OF THE INVENTION

Inverted-F antennas are commonly used in mobile transmitter/receivers, such as cellular telephones and wireless modems for portable computers. FIG. 1 illustrates a conventional inverted-F antenna 100. As shown in FIG. 1, the inverted-F antenna 100 has a vertical ground 110 and a straight horizontal element 120. Conventional inverted-F antennas, such as the inverted-F antenna 100 of FIG. 1 can be fabricated on a printed circuit board (PCB), or using a wire or plate construction, in a well-known manner. For a detailed discussion of conventional inverted-F antennas, see, for example, Kazuhiro Hirasawa and *5 AsMisao Haneishi, "Analysis, Design, and Measurement of Small and Low-Profile Antennas," Artech House, Norwood, Mass (1992); or Kyohei Fujimoto et al., "Small Antennas," Research Studies Press, United Kingdom (1987), each incorporated by reference herein.

Inverted-F antennas are generally characterized by the distance, S, between the grounding element 110 and feeding element 130; the overall length, L, of the antenna 100; and the height, H, of the antenna 100. Impedance matching for an inverted-F antenna is obtained by adjusting the distance, S, between the grounding and feeding elements. As the size of the devices in which inverted-F antennas are utilized has decreased, the space available for such inverted-F antennas has likewise decreased. For many applications, the distance, S, between the grounding element 110 and feeding element 130 has become so small that the tuner must be extremely sensitive. In particular, the impedance matching is very difficult or too sensitive due to the small distance, S, between the grounding 110 and the feeding elements 130. In addition, the rectangular shape of conventional inverted-F antennas 100 does not provide sufficient mechanical strength for many applications.

A need therefore exists for an improved inverted-F antenna that exhibits improved impedance matching and mechanical strength. A further need exists for an improved inverted-F antenna that has a reduced overall dimension and an additional degree of freedom for tuning the impedance of the antenna.

SUMMARY OF THE INVENTION

Generally, a modified inverted-F antenna is disclosed that improves on conventional designs by incorporating a sloped grounding element at a fixed end of the horizontal element and a downward bend at a loose end of the horizontal element. According to one aspect of the invention, the sloped grounding element is connected in a triangular configuration with the feeding element and a ground plane of the antenna, to provide additional benefits. First, the triangular shape of the present invention decreases the distance, D, between the grounding plane and the feeding element relative to a conventional rectangular connection. Thus, the present invention exhibits improved impedance matching characteristics. The distance, D, between the grounding plane and the feeding element can be expressed as follows:

$$D=\sqrt{H^2+S^2}.$$

where H is the height of the antenna and S is the horizontal spacing between the feeding element and where the sloped grounding element connects to the grounding plane.

In addition, the triangular shape provides increased mechanical strength relative to a conventional rectangular connection. According to another feature of the invention, the downward bend at the loose end of the antenna can be adjusted to thereby further adjust the impedance matching of the antenna.

The sloped grounding element and downward bend features of the modified inverted-F antenna also serve to reduce the overall dimension of the antenna. The total length, $L_T$, of the disclosed antenna device can be expressed as follows:

$$L_T=\sqrt{H^2+S^2}+L_1\sqrt{B_{h^2+B_{v^2}}}.$$

where H is the height of the antenna, S is the horizontal spacing between the feeding element and point where the sloped grounding element connects to the grounding plane, $L_1$ is the length of a horizontal portion of said horizontal element, $B_v$ is the vertical distance of said downward bend and $B_h$ is the horizontal distance of said downward bend.

A more complete understanding of the present invention, as well as further features and advantages of the present invention, will be obtained by reference to the following detailed description and drawings.

DETAILED DESCRIPTION OF PREFERRED EMBODIMENTS

Figure 2:
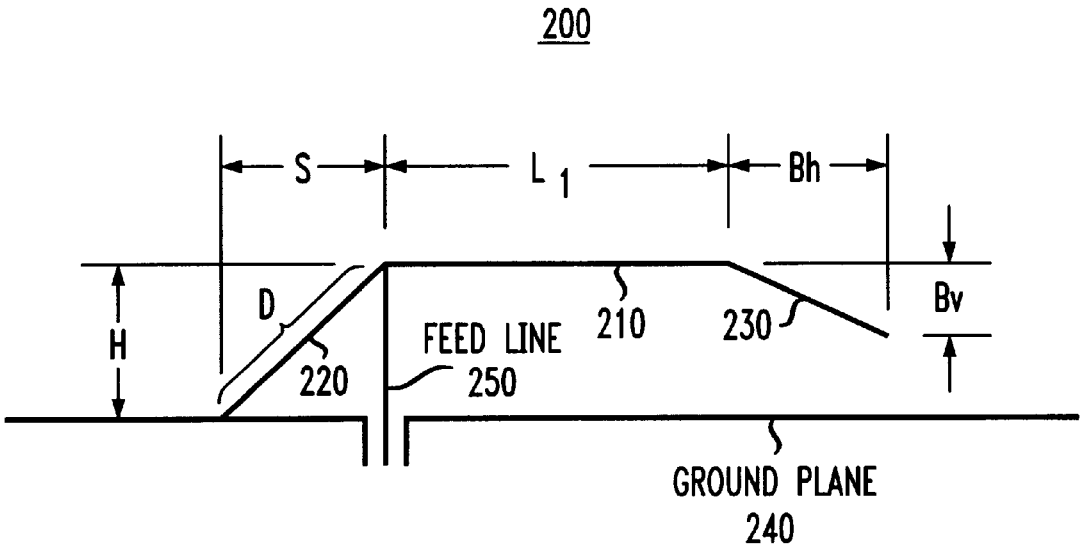
FIG. 2 illustrates a modified inverted-F antenna in accordance with the present invention.

FIG. 2 shows the general configuration of a modified inverted-F antenna 200 in accordance with the present invention. As shown in FIG. 2, the modified inverted-F antenna 200 has a horizontal element 210 that includes a sloped grounding element 220 and a downward bend 230 that ensure the robustness of the antenna 200. The a loped grounding element 220 at the fixed end of the inverted-F antenna 200 decreases the distance, D, between the grounding plane 240 and the feeding element 250. The distance, D, between the grounding plane 240 and the feeding element 250 can be obtained as follows:

$$D=\sqrt{H^2+S^2}.$$

Figure 1:
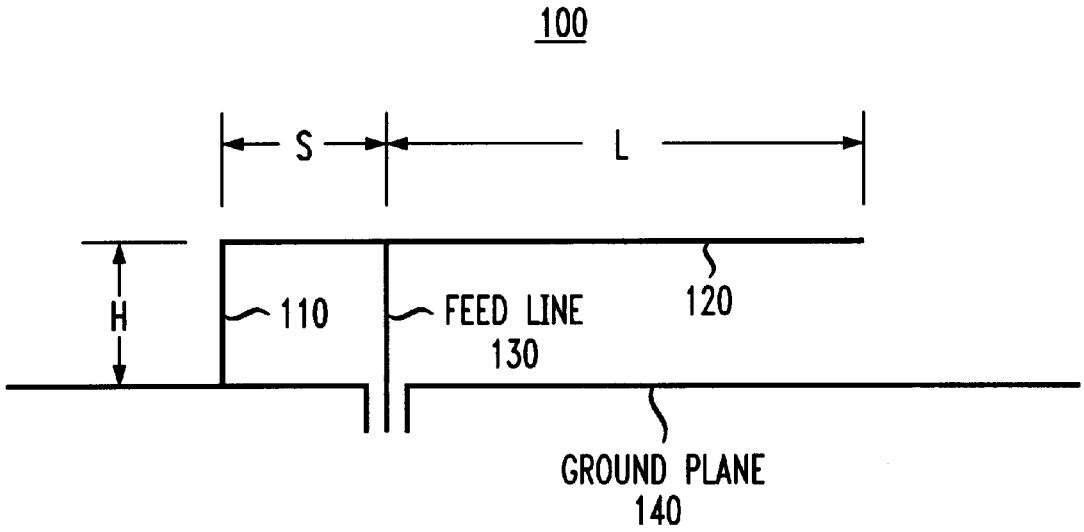
FIG. 1 PRIOR ART
FIG. 1 illustrates a conventional inverted-F antenna.

Thus, unlike conventional inverted-F antennas, such as the antenna 100 shown in FIG. 1, the decreased distance to ground, D, of the modified inverted-F antenna 200 avoids impedance matching difficulties due to very small values of S. In addition, the triangular shape formed by the sloped grounding element 220, the feed line 250 and the ground plane 240 provides increased mechanical strength for the antenna 200.

As shown in FIG. 2, a downward bend 230 is used at the loose end of the inverted-F antenna 200. The downward bend 230 serves two purposes. First, the bending 230 can change the impedance matching, and thereby provides another mechanism to tune the impedance of the antenna 200. Second, the bending 230 will reduce the overall dimension occupied by the antenna 200. As previously indicated, the overall dimension is very important for some applications, especially mobile applications.

Similar to the conventional inverted-F antenna 100 discussed above, the resonate frequency of the modified inverted-F antenna 200 is primarily determined by the total length of the antenna. Thus, the total length, $L_T$, of the conventional inverted-F antenna 100 is obtained as follows:

$$L_T=H+S+L.$$

Likewise, the total length, $L_T$, of the modified inverted-F antenna 200 is obtained as follows:

$$L_T=\sqrt{H^2+S^2}+L_1+\sqrt{B_{h^2+B_{v^2}}}.$$

It is noted that increasing the height, H, of the antenna 200 will increase the antenna bandwidth. Thus, given an antenna height, H, the spacing, S, is adjusted to achieve impedance matching.

Figure 3A:
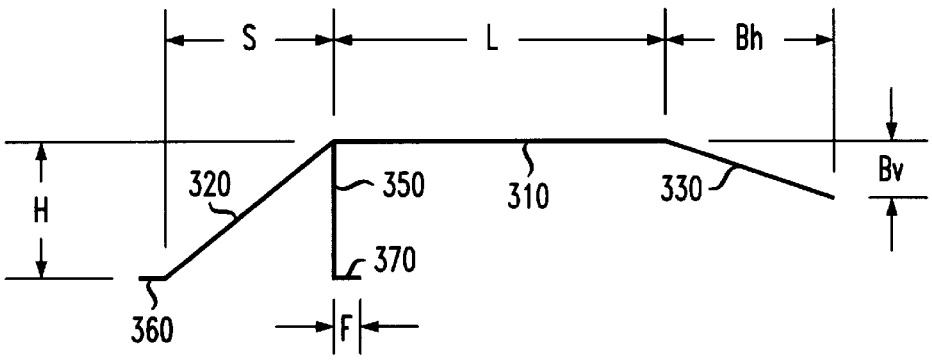
FIGS. 3A and 3B illustrate a side and top view, respectively, of an implementation of a modified inverted-F antenna in accordance with the present invention.
Figure 3B:
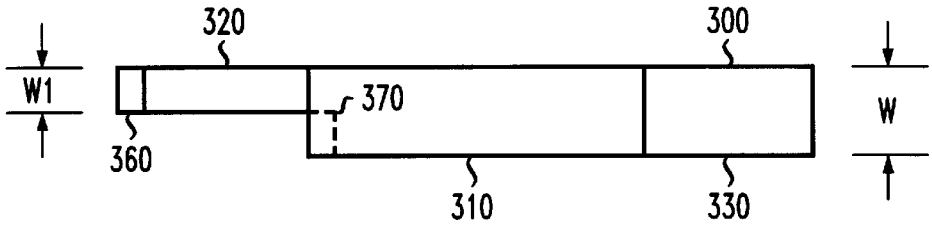

FIGS. 3A and 3B show a side view and a top view, respectively, of an implementation of a modified inverted-F antenna 300 stamped from a metal sheet, such as brass or copper. The two small bents 360, 370 at the bottom of the antenna 300 are used as soldering points. In this manner, the antenna 300 can be soldered to a printed circuit board (PCB) or some other metal structures. It is noted that the design of the implementation of FIGS. 3A and 3B only requires two soldering points. As shown in FIG. 3B, the width, $W_1$, of the sloped grounding element 320 and the overall width, W, of the antenna 300 can be adjusted for maximum impedance bandwidth within given space availability.

Figure 4:
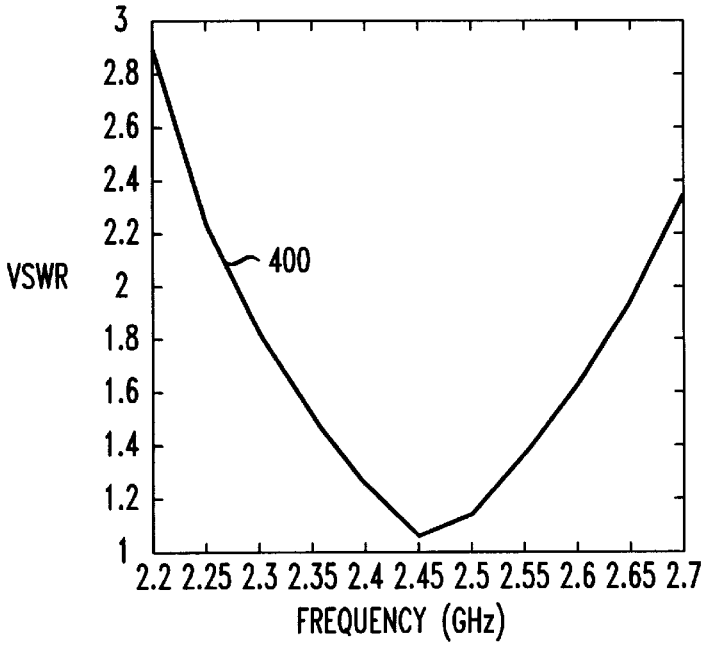
FIG. 4 illustrates the Voltage Standing Wave Ratio (VSWR) of the modified inverted-F antenna of FIGS. 3A and 3B on a small ground plate.

FIG. 4 shows the Voltage Standing Wave Ratio (VSWR) 400 of the antenna 300. With a proper design, a 2:1 frequency bandwidth can be as wide as 300 MHz, which is wide enough for 2.4 GHz ISM applications. The 2.4 GHz band is centered at 2.45 Ghz with a 100 MHz bandwidth.

It has been found that the total radiation pattern of the modified inverted-F antennas 200 of the present invention are close to omnidirectional.

It is to be understood that the embodiments and variations shown and described herein are merely illustrative of the principles of this invention and that various modifications may be implemented by those skilled in the art without departing from the scope and spirit of the invention.

What is claimed is:

1. An antenna device, comprising:

a horizontal element having a horizontal portion parallel to a grounding plane, a fixed end and a loose end, said horizontal element including a sloped grounding element at said fixed end having a non-perpendicular relationship with said horizontal portion, and a downward bend at said loose end; and a feeding element electrically connected to said sloped grounding element.

2. The antenna device of claim 1, wherein a distance, D, between said grounding plane and said feeding element can be obtained as follows:

$$D=\sqrt{H^2+S^2}$$

where H is the height of said antenna and S is the horizontal spacing between said feeding element and where said sloped grounding element connects to said grounding plane.

3. The antenna device of claim 2, wherein said sloped grounding element, said feeding element and said ground plane are connected in a triangular shape to decrease said distance, D, relative to a rectangular connection.

4. The antenna device of claim 1, wherein an angle of said downward bend at said loose end can be adjusted to adjust the impedance matching of said antenna device.

5. The antenna device of claim 1, wherein said sloped grounding element at said fixed end reduces the overall dimension of said antenna device.

6. The antenna device of claim 1, wherein said downward bend at said loose end reduces the overall dimension of said antenna device.

7. The antenna device of claim 4, wherein a total length, $L_T$, of said antenna device is obtained as follows:

$$L_T=\sqrt{H^2+S^2}+L_1+\sqrt{B_{h^2+B_{v^2}}}$$

where H is the height of said antenna, S is the horizontal spacing between said feeding element and where said sloped grounding element connects to said grounding plane, $L_1$ is the length of a horizontal portion of said horizontal element, $B_v$ is the vertical distance of said downward bend and $B_h$ is the horizontal distance of said downward bend.

8. The antenna device of claim 1, wherein said sloped grounding element, said feeding element and said ground plane are connected to provide a triangular shape.

9. The antenna device of claim 8, wherein said triangular shape provides increased mechanical strength relative to a rectangular connection.

10. An antenna device, comprising:

a horizontal element having a horizontal portion, a fixed end and a loose end, said horizontal element including a sloped grounding element at said fixed end having a non-perpendicular relationship with said horizontal portion; and a feeding element electrically connected to said horizontal element.

11. The antenna device of claim 10, wherein a distance, D, between said grounding plane and said feeding element can be obtained as follows:

$$D=\sqrt{H^2+S^2}$$

where H is the height of said antenna and S is the horizontal spacing between said feeding element and where said sloped grounding element connects to said grounding plane.

12. The antenna device of claim 11, wherein said sloped grounding element, said feeding element and said ground plane are connected in a triangular shape to decrease said distance, D, relative to a rectangular connection.

13. The antenna device of claim 10, wherein said sloped grounding element at said fixed end reduces the overall dimension of said antenna device.

14. The antenna device of claim 10, wherein said sloped grounding element, said feeding element and a ground plane are connected to provide a triangular shape.

15. The antenna device of claim 14, wherein said triangular shape provides increased mechanical strength relative to a rectangular connection.

* * * * *

UNITED STATES PATENT AND TRADEMARK OFFICE

CERTIFICATE OF CORRECTION

PATENT NO. : 6,222,496 B1
DATED : April 24, 2001
INVENTOR(S) : Liu

It is certified that error appears in the above-identified patent and that said Letters Patent is hereby corrected as shown below:

Column 2,
Lines 11-12, replace "$L_T = \sqrt{H^2 + S^2} + L_1 \sqrt{B_{h^2+Bv^2}}$" with -- $L_T = \sqrt{H^2 + S^2} + L_1 + \sqrt{B_h{}^2 + B_v{}^2}$ --.

Line 43, after "The" replace "a loped" with -- sloped --.

Column 3,
Lines 11-12, replace "$L_T = \sqrt{H^2 + S^2} + L_1 + \sqrt{B_{h^2+Bv^2}}$" with -- $L_T = \sqrt{H^2 + S^2} + L_1 + \sqrt{B_h{}^2 + B_v{}^2}$ --.

Column 4,
Line 17, replace "$L_T = \sqrt{H^2 + S^2} + L_1 + \sqrt{B_{h^2+Bv^2}}$" with -- $L_T = \sqrt{H^2 + S^2} + L_1 + \sqrt{B_h{}^2 + B_v{}^2}$ --.

Signed and Sealed this

Eighteenth Day of October, 2005

JON W. DUDAS
*Director of the United States Patent and Trademark Office*